US006896225B2

(12) United States Patent
Tabor

(10) Patent No.: US 6,896,225 B2
(45) Date of Patent: May 24, 2005

(54) KITE WITH MOVABLE FIGURE

(76) Inventor: Don Tabor, 556 Florence St., Imperial Beach, CA (US) 91932

( * ) Notice: Subject to any disclaimer, the term of this patent is extended or adjusted under 35 U.S.C. 154(b) by 0 days.

(21) Appl. No.: 10/617,311

(22) Filed: Jul. 10, 2003

(65) Prior Publication Data

US 2005/0006531 A1 Jan. 13, 2005

(51) Int. Cl.[7] ..... B64C 31/06
(52) U.S. Cl. ..... 244/153 R; 446/34
(58) Field of Search ..... 244/32, 153 R, 244/154, 155 R; 446/199, 34

(56) References Cited

U.S. PATENT DOCUMENTS

| | | | | |
|---|---|---|---|---|
| 2,461,465 A | | 2/1949 | Chu et al. | 244/153 |
| 3,034,751 A | | 5/1962 | Droullard | 244/155 |
| 3,161,386 A | | 12/1964 | Umanoff | 244/153 |
| 3,582,026 A | | 6/1971 | Giolitto | 244/155 |
| 3,920,201 A | | 11/1975 | Battles | 244/16 |
| 3,949,519 A | | 4/1976 | Meyer | 46/79 |
| 4,133,500 A | | 1/1979 | Chapman | 244/153 |
| 4,159,087 A | | 6/1979 | Moomaw | 244/153 |
| 4,170,084 A | | 10/1979 | Fierheller | 46/79 |
| 4,369,939 A | | 1/1983 | Elson | 244/155 |
| 4,408,412 A | * | 10/1983 | Forker | 446/225 |
| 4,450,784 A | | 5/1984 | Mellinger | 114/39 |
| 4,512,690 A | | 4/1985 | Johnson | 446/61 |
| 4,655,720 A | | 4/1987 | Renger et al. | 446/61 |
| 4,705,239 A | | 11/1987 | Baird | 244/155 |
| 4,799,634 A | * | 1/1989 | Beaulieu | 244/155 R |
| 4,911,383 A | | 3/1990 | Elson | 244/153 |
| 5,118,054 A | * | 6/1992 | Kirschenbaum et al. | 244/153 R |
| 5,524,851 A | | 6/1996 | Huang | 244/153 |
| 5,755,405 A | * | 5/1998 | Socha et al. | 244/142 |
| 5,803,784 A | | 9/1998 | Plow et al. | 446/176 |
| 5,810,637 A | * | 9/1998 | Mileti | 446/61 |
| 5,893,537 A | * | 4/1999 | Lee | 244/153 R |
| 6,074,267 A | | 6/2000 | Plow | 446/176 |
| 6,102,765 A | | 8/2000 | Forti et al. | 446/62 |
| 6,527,607 B1 | * | 3/2003 | Huang | 446/34 |

FOREIGN PATENT DOCUMENTS

| | | | | |
|---|---|---|---|---|
| GB | 2101899 A | * | 1/1983 | A63H/27/08 |
| WO | WO 97/36661 | | 10/1997 | A63H/33/40 |

* cited by examiner

*Primary Examiner*—Robert P. Swiatek
(74) *Attorney, Agent, or Firm*—Louis J. Bachand

(57) ABSTRACT

A flying toy system including a kite portion, and a figure coupled to the kite portion that moves with respect to its coupling with the kite portion.

22 Claims, 5 Drawing Sheets

KITE WITH MOVABLE FIGURE

BACKGROUND

The popularity of kites has boomed in recent decades, and novelty kites are particularly in demand since many consumers want kites that are unique, that stand out from the rest of the kites, and that constitute a personalized expression that consumers want to make.

Very few flying toys have included a rigid toy human figure or other weighted mass suspended from the toy, or a parachute component thereof. Even fewer are able to make it appear as though the flying toy is acting similar to what a real device would act like when in use.

SUMMARY

A flying toy, such as a kite, with a ballast that may be configured to move relative to the toy during flight, is provided. The ballast could be in the form of a human, an animal, a fanciful creature, or even an inanimate object. The size and weight of the ballast may be comparable to that of the kite, such that the ballast is weighted sufficiently to affect the flight characteristics of the kite, whereby movement of the ballast during flight and/or wind effects on the ballast itself causes a somewhat noticeable change in the kite's flight characteristics.

In one embodiment, the ballast has generally flexible portions. According to another embodiment, the kite is in the form of a water or air vehicle, such as a ship, boat, or plane, and includes a sail. In another embodiment, the ballast is removably, selectively, positionally coupled to the kite at one or more attachment points, and in a number of different orientations, for both aesthetics and functionality, as desired by the user.

DETAILED DESCRIPTION

The detailed description set forth below in connection with the appended drawings is intended as a description of exemplary embodiments and is not intended to represent the only forms in which the embodiments may be constructed and/or utilized. The description also sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
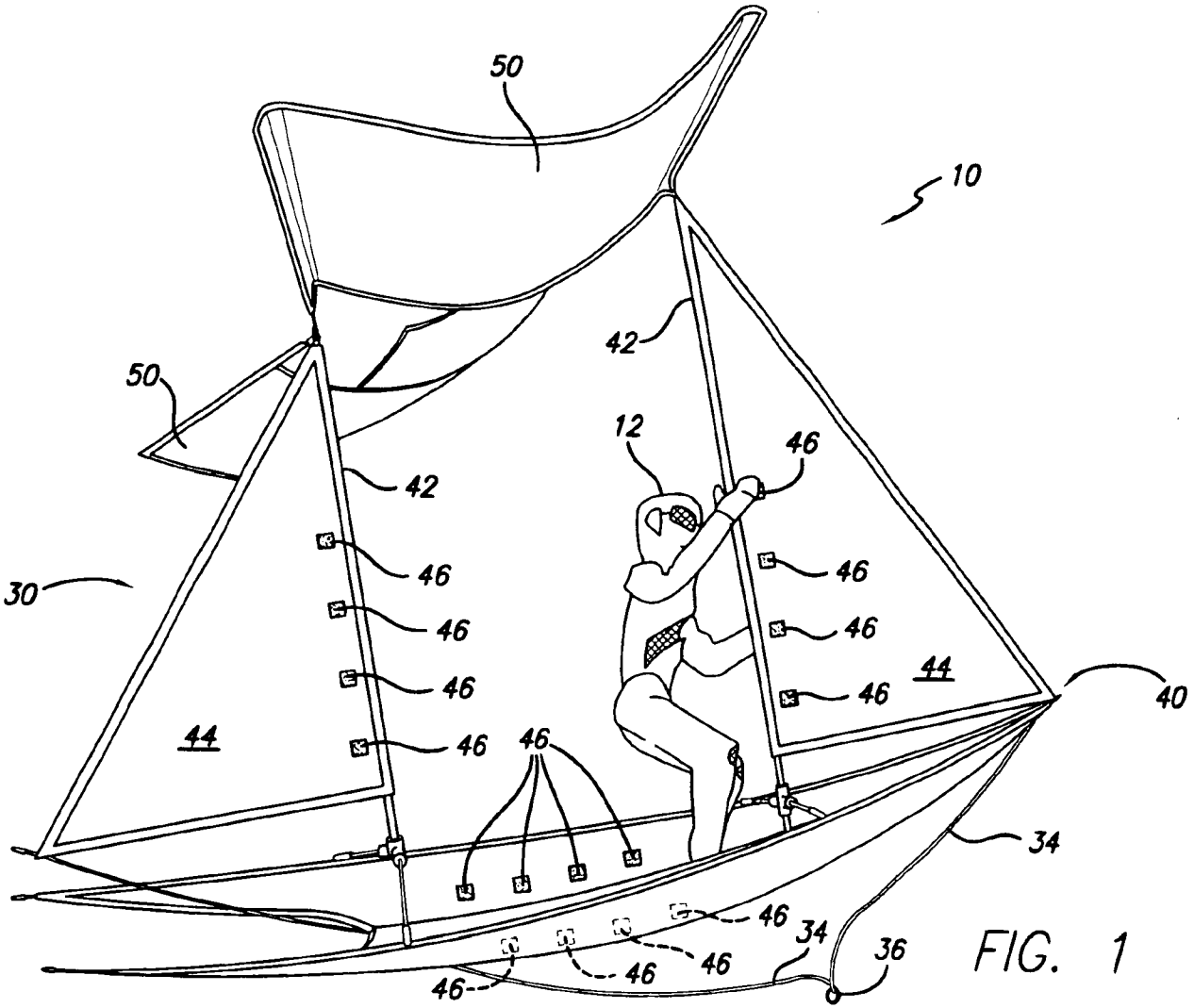
FIG. 1 is a side perspective view of a flying toy in the form of a sailboat kite, including a ballast in accordance with one exemplary embodiment.

FIG. 1 shows a flying toy system according to one exemplary embodiment, generally at 10. Flying toy system 10 typically includes a ballast 12 that is typically coupled to a kite 30. Kite 30 typically includes a hull portion 40 and lift member 50. Lift member 50 is typically configured to provide lift for the system when in flight. Hull portion 40 of kite 30 may optionally include masts 42 and sails 44, as well as coupling structures 46. It will be appreciated that although kite 30 is shown as a boat or other aquatic vehicle, many other designs may be utilized, including a whimsical airship, among others, as desired.

Ballast 12 is removably, selectively, positionally coupled to kite 30 to alter the appearance, and the flight characteristics of the entire system, when in flight. Ballast 12 is typically coupled to kite 30 above hull portion 40, however, other configurations may be utilized, as desired. Ballast 12 may also move continually or intermittently when in flight, thereby changing the flight characteristics of the system 10. The flight characteristics include, but are not limited to, the center of gravity, the altitude and direction the kite is flying, and the airspeed of the kite.

Figure 4:
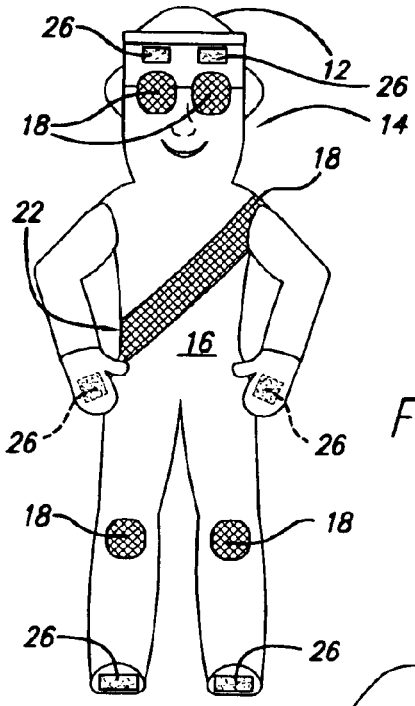
FIG. 4 is a front view of a ballast in a human-like form in accordance with an exemplary embodiment.

This configuration may make the system act as if the system is riding on water, bouncing over waves, and the like. Ballast 12 also includes mating structures that allow it to couple to coupling structure 46 in many different positions throughout the system. With this configuration, ballast 12 may be coupling to the kite 30 in many different positions and configurations to alter the appearance and the flight characteristics of the system when in flight, as desired. The mating structures 26 may be located at many positions on the surfaces of ballast 12. For example, FIG. 4 illustrates mating structures 26 located on the hands and feet of a ballast 12 in the form of a human windsurfer. The present invention also contemplates many other forms of ballast 12 and many other locations for the mating structures 26, such as in the seat area of a human or animal figure for the effect of emulating sitting, or the back area for emulating the effect of soaring by the figure.

Kite 30 is typically made from nylon, fabric, and plastic and rubber-like compounds, but may be made from other materials as desired.

As an illustrative, but non-limiting example, the kite 30, with lift members 50, weighs approximately 4.0–7.0 ounces, and has a hull portion 40, which is approximately 30–45 inches long, 8–12 inches wide, and 2–4 inches deep. Additionally, the hull forks at approximately 28 inches from its front end. The sails 44 are typically between 10–14 inches in length, and 18–22 inches in height. Lift members 50 may be optionally attached or detached from the top of masts 42, and may be rectangular or parallelogram shaped, are typically 13–20 inches by 10–16 inches in length and width respectively. The ballast 12 may include slightly bent knees and is approximately 12–20 inches tall and has average head and body diameters of approximately 1–4 inches, and weighs about 0.4–2.0 ounces.

Additionally, the system 10 typically has string segments 34 which are approximately 10–30 inches in length, connected to the front and rear, or other portion of hull portion 40, whereby the string segments are joined at a common point, which may include a connecting structure 36 as shown in the figure, for connection to a third long string (not shown) held by the user. Connecting structure 36 is shown as a ring-type connector, however, it will be appreciated that other connecting structures may be utilized, as desired.

Besides being in the form of a human, the ballast may also be in the form of an animal, fanciful or whimsical creature, or inanimate object. Furthermore, the kite itself may be in the form of various vehicles and other objects, including fanciful vehicles and objects, which may incorporate a figure including a ship, airplane, car, surfboard, snowboard, skateboard, house, etc. Additionally, more than one ballast in accordance with the exemplary embodiments may be attached to a single kite.

Figure 2:
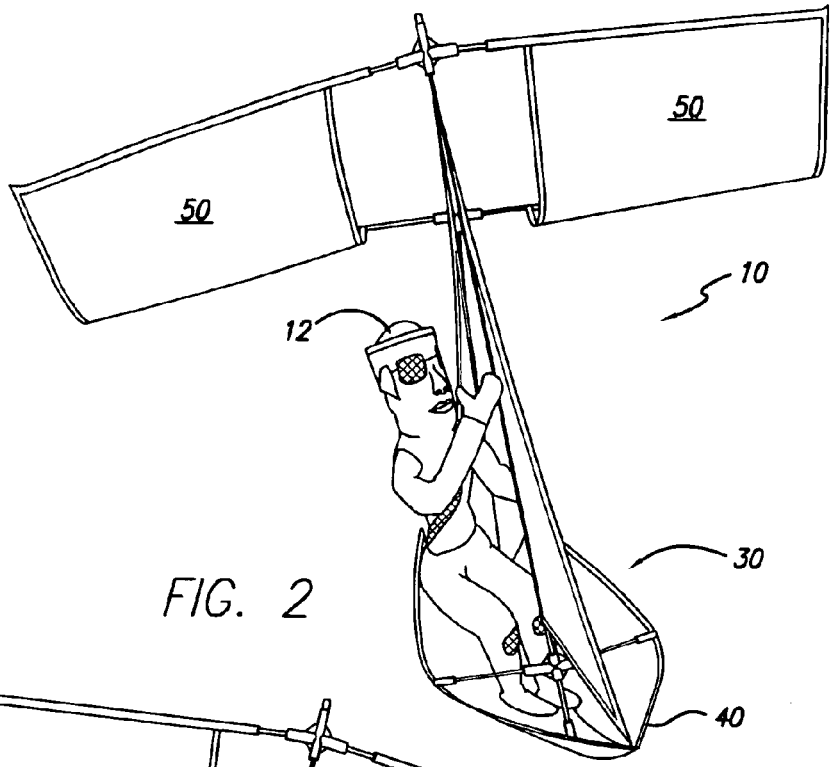
FIG. 2 is a front perspective view of the kite of FIG. 1, illustrating the ballast shifted to one side of the sailboat kite.

FIG. 2 shows the flying toy system 10 from FIG. 1 from a front perspective view. System 10 again includes a kite portion 30 and a ballast 12 coupled to it, as well as lift members 50 to provide lift for the system. In this figure, ballast 12 has moved to one side of the center of gravity of the entire system, simulating a person in a sailboat or on a sail board, and the like.

Lift members 50 are typically a rectangular shape and coupled to the system above hull portion 40, however, it will be appreciated that other shapes and configurations may be utilized, as desired.

During flight, ballast 12, which is illustrated as attached approximately at a central location on the sailboat kite 30, may pivot from side to side depending on the orientation of the sailboat kite 30 and wind affects on the ballast 12, thus resembling the actual human motion when sailing or sailboarding, or the like.

Figure 3:
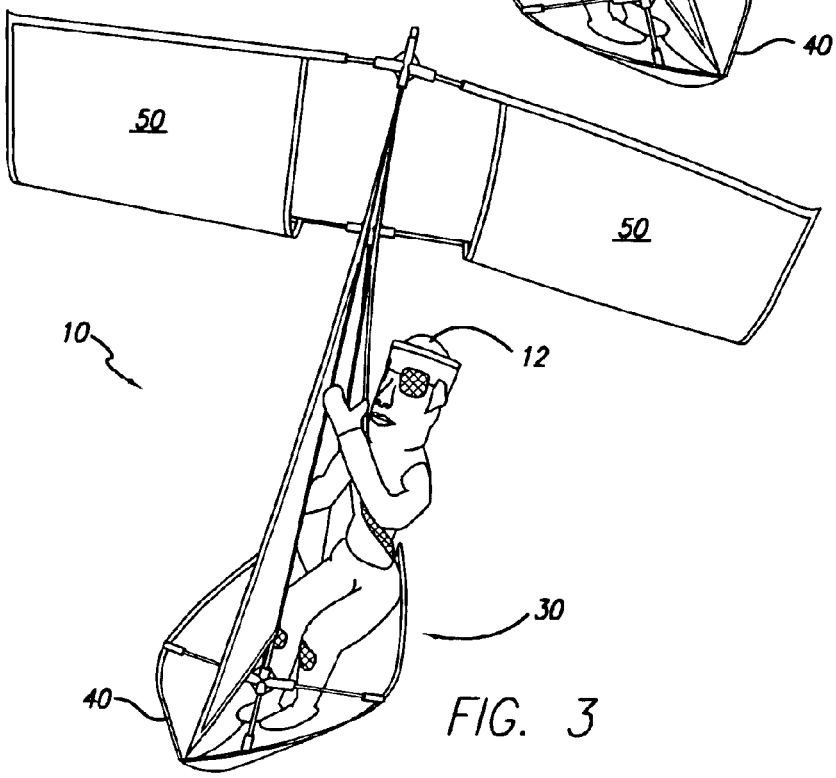
FIG. 3 is a view similar to FIG. 2, illustrating the ballast shifted to the opposite side of the sailboat as shown in FIG. 2.

FIG. 3 shows the ballast moved to the opposite side of the center of gravity of the entire system of that shown in FIG. 2. System 10 again includes a kite 30 and a ballast 12 coupled to it. The system further includes lift members 50 that provide lift for the system. Ballast 12 may continually or intermittently move during flight such that it looks as if a person is sailing, or sail boarding, or the like.

FIG. 4 shows a ballast 12 according to one exemplary embodiment. Ballast 12 typically includes a housing 14 which may be divided into an airfoil portion 16 and mesh portion 18. Airfoil portion 16 may be configured to catch air, to deflect air, and to change the characteristics of the ballast 12, and consequently the flight characteristics of the overall system when in flight. Mesh portion 18 may allow air to pass through to inflate ballast 12 and to allow airfoil portion 16 to deflect air. In FIG. 4, ballast 12 is shown resembling a human figure, it will be appreciated that other figures may be utilized, including animals, caricatures, whimsical figures, and other inanimate objects, as desired. In this figure mesh portions 18 are shown as the eyes and near the knees of the human-like figure, as well as a sash running across the chest of the human figure. It will be appreciated that other configurations may be utilized to change the characteristics of ballast 12.

Ballast 12 also includes mating structures 26, located at various locations on ballast 12. Coupling structure 26 typically is configured to couple to coupling structure 46 of kite 30, such that ballast 12 is coupled to kite 30. Mating structures 26 and coupling structure 46 are typically a hook and loop configuration, but other coupling structures may be utilized as desired. It will be appreciated that, although certain locations on ballast 12 for mating structure 26 are shown in FIG. 4, numerous locations for mating structure 26 may be utilized, including most or all of ballast 12, as desired. For example, the hands of the figure may be coupled at low points, such that the figure appears to be bending. Additionally, the figure may be formed with slightly bending knees to more closely resemble the form of a human operating a sailboat, sailboard, or the like.

Ballast 12 is typically made of kite material such as nylon, plastic, or rubber-like materials, that are flexible, but may also be rigid, or partially rigid, or combinations thereof. With this configuration, ballast 12 may be connected at certain points of ballast 12 to kite 30 such that the remainder of ballast 12 will move continually during flight of the system with respect to kite 30. Furthermore with this configuration, different points of ballast 12 may be connected to numerous different points of kite 30, as desired.

Ballast 12 also typically includes fill material 22 to add weight to the system as well as to keep the form of ballast 12 when not inflated. Fill material is typically foam, or other lightweight fill material. It will be appreciated that other materials may be utilized such as cotton, feathers, or synthetic filling, typically used for stuffing plush animals, pillows, and the like, which allow air to circulate through the body of ballast 12, as desired.

The size and weight of the ballast may be comparable to that of the kite, such that the ballast is weighted sufficiently to affect the flight characteristics of the kite, whereby movement of the ballast during flight and/or wind effects on the ballast itself cause significant change in the kite's flight characteristics.

Figure 5:
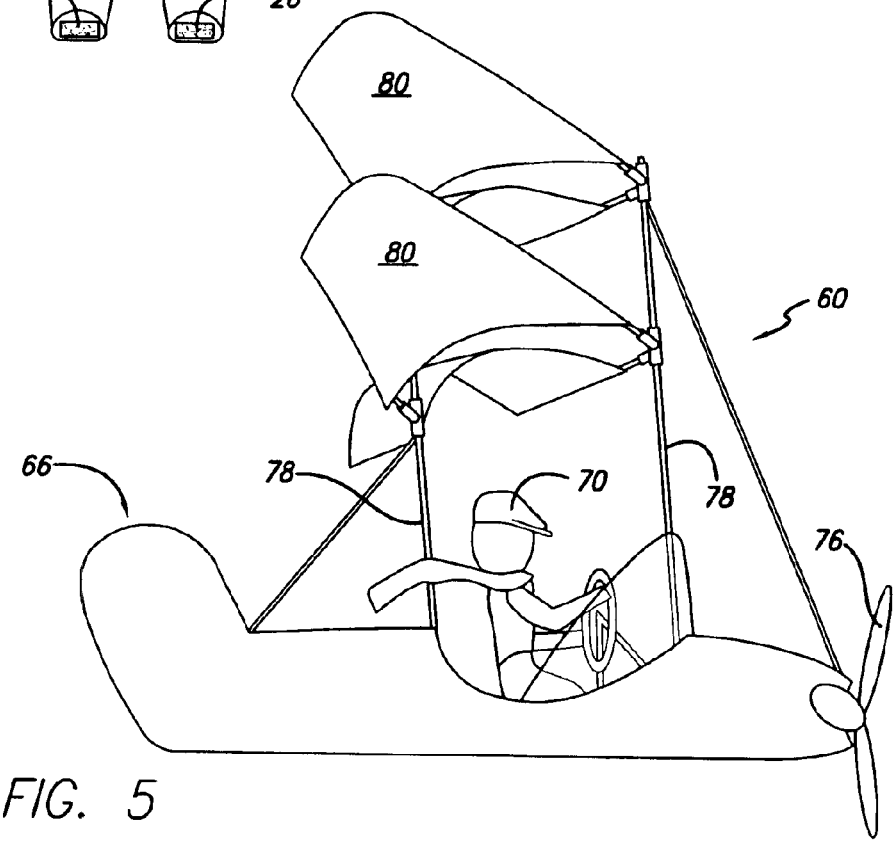
FIG. 5 is a side perspective view of a flying toy in an aircraft-like form and including a human-like ballast in accordance with another exemplary embodiment.

FIG. 5 is a perspective view of a flying toy system 60 according to another exemplary embodiment. System 60 typically includes a kite 66 and a ballast 70. In this embodiment, the kite is in the shape of an airplane, and the ballast is made to look somewhat like a pilot of an aircraft. In this embodiment, system 60 includes a propeller 76 which may be for ornamental or non-ornamental purposes. Kite 66 includes masts 78, as well as lift members 80. Lift members 80 are configured to deflect air and provide lift for the entire system when in flight.

Figure 6:
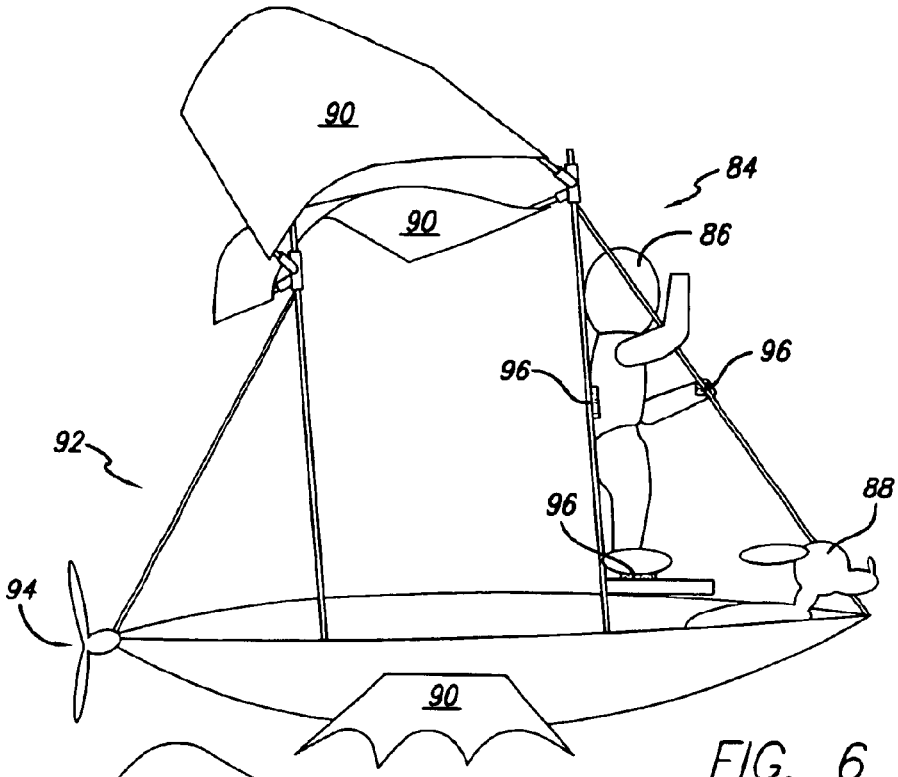
FIG. 6 is a side perspective view of a flying toy in an air or water ship-like form including a human-like and animal-like ballast in accordance with another exemplary embodiment.

FIG. 6 shows a system according to an exemplary embodiment, generally at 84. System 84 again includes ballast 86, as well as a second ballast 88 that are configured to couple to a kite 92. In this embodiment, kite 92 may take the form of a whimsical flying ship, such as Captain Nemo-like or other animated movie-like vehicles. System 84 again includes lift members 90 above the kite, as well as on the side of the kite. System 84 may alternatively include a propeller 94 that is used for ornamental or non-ornamental purposes. Ballast 86 and 88 are typically coupled to the kite using a coupling structure 96 similar to the previously described coupling structures, such as a hook and loop type fastening structure.

In this embodiment, ballast 86 is in the form of a human-like caricature, and ballast 88 is in the form of a dog or other animal type figure. It will be appreciated, however, that although ballasts are shown as human figures and animal figures, many other whimsical cartoon-like and caricatures can be used, as desired. Furthermore, any number of ballasts may be utilized, and ballasts may be used with more than one system, as desired.

Figure 7:
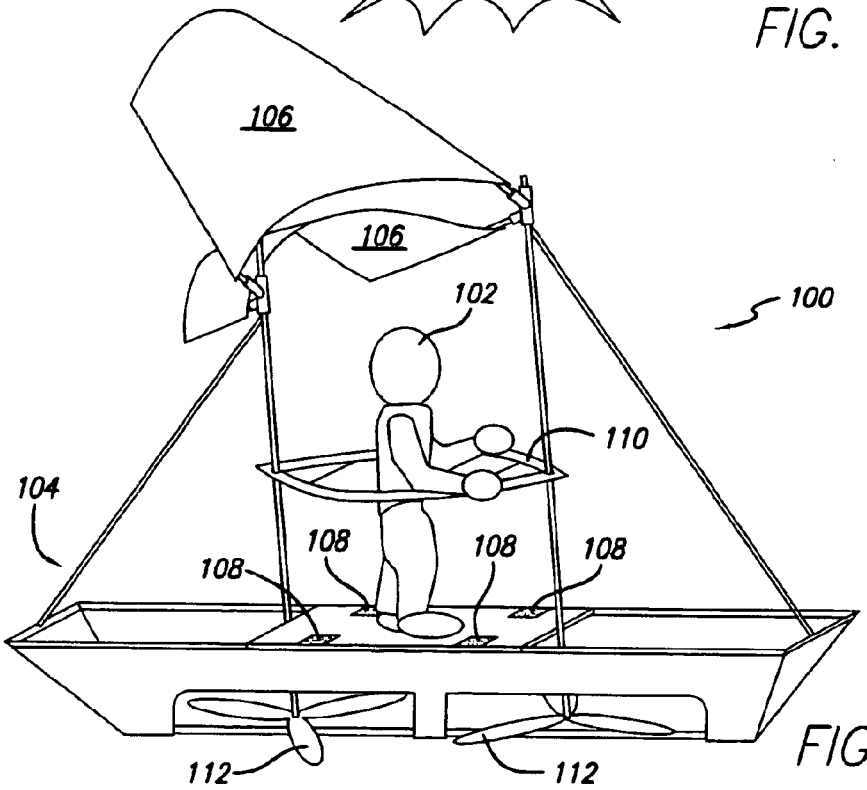
FIG. 7 is a side perspective view of a flying toy in the form of a boat including a human-like ballast and a cage in accordance with another exemplary embodiment.

FIG. 7 shows another system 100 according to yet another exemplary embodiment. System 100 typically includes ballast 102 coupled to a kite 104. In this embodiment, ballast 102 is again in a human-like figure, but others may be utilized as desired. System 100 also typically includes lift members 106 that are configured to deflect air when in flight to provide lift for the system. System 100 also typically includes coupling structure 108 similar to other coupling structures described herein, but other types of coupling configurations may be used. System 100 may also include a cage 110 that may be configured to limit the movement and travel of ballast 102, when the system is in flight or non-flight. This may add stability to the system and provide for better flight characteristics. System 100 may also include propellers 112 that may alter the flight characteristics of the system when in flight, or may be utilized for ornamental reasons, and may rotate when the system is in flight.

Figure 8:
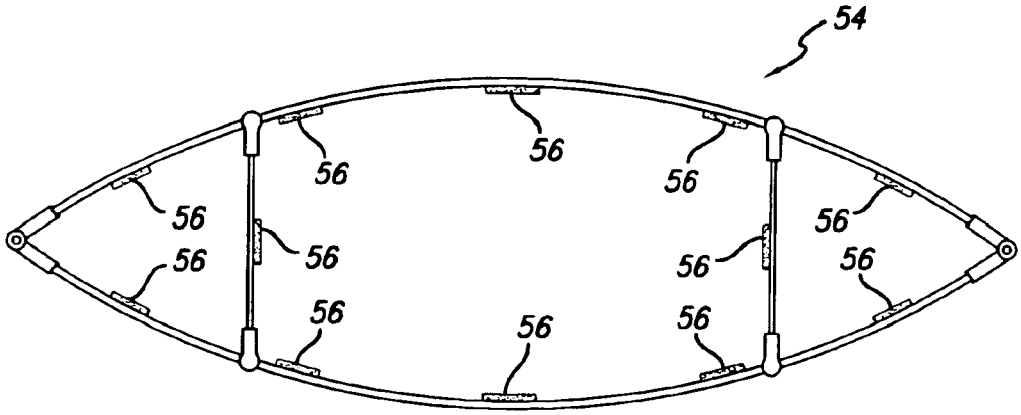
FIG. 8 is a top view of a hull including coupling structures in accordance with an exemplary embodiment.

FIG. 8 is a top view of a hull portion 54 according to another exemplary embodiment of the present invention, showing many different locations for coupling structure 56. Coupling structure 56 may be located at specific points, or entire portions of the system. Furthermore, coupling structure 56 may be made from either a hook or loop configuration, or other coupling configuration, such that a ballast may be attached in an infinite number of positions within the system. FIG. 8 shows the coupling structures 56 mounted on braces, masts, and other portions of the system as well as on hull portion 54. The coupling structure 56 may include holes, through which rods of the kite may be inserted, such that coupling structure 56 moves with the figure.

While the examples described herein illustrate a ballast positioned atop the surface of the kite, it should be understood that embodiments wherein a ballast is positioned below the kite surface is also contemplated by the present invention. Such embodiments may be advantageous in that the figure will be more readily seen by viewers on the ground. Additionally, a flexible figure in accordance with the exemplary embodiments may be attached to other flying toys such as gliders, and the like, as desired.

In closing, it is to be understood that the exemplary embodiments described herein are illustrative of the principles of the present invention. Other modifications that may be employed are within the scope of the invention. Thus, by way of example, but not of limitation, alternative configurations may be utilized in accordance with the teachings herein. Accordingly, the drawings and description are illustrative and not meant to be a limitation thereof.

What is claimed is:

1. A flying toy system, comprising:

a kite portion, and a figure, having a human-like or animal-like form, said kite portion and said figure each having plural hook and loop coupling and mating structures attaching said figure at certain points to said kite portion, such that the remainder of said figure will move during flight of said system with respect to said kite portion.

2. The flying toy system of claim 1, further comprising a cage carried by said kite portion and configured to limit the movement of said figure when said system is in flight.

3. The flying toy system of claim 1, wherein said kite portion comprises:

a body portion; and one or more airfoil portions coupled to said body portion;

wherein said one or more airfoil portions deflect air to provide lift for the system.

4. The flying toy system of claim 3, wherein said body portion is in the form of a boat.

5. The flying toy system of claim 3, wherein said body portion is in the form of a sailboard.

6. The flying toy system of claim 3, wherein said one or more airfoil portions are in the form of a sail.

7. The flying toy system of claim 3, wherein said figure is coupled to said kite portion above said body portion.

8. The flying toy system of claim 1, wherein said figure is removably, selectively and positionally coupled to said kite portion.

9. The flying toy system of claim 1, wherein said figure has hands having said mating structures, said mating structures being coupled at low points to said kite portion coupling structures such that the figure appears to be bending when in flight.

10. The flying toy system of claim 1, wherein said figure includes fill material.

11. The flying toy system of claim 1, wherein said figure remainder is flexible.

12. The flying toy system of claim 1, wherein said figure is configured to inflate when in flight.

13. A figure for a flying toy having a coupling structure, comprising:

a flexible housing having mating structure for said coupling structure that removably, selectively, and positionally couples said figure to said flying toy;

said flexible housing having an airfoil portion and a mesh portion, said mesh portion being configured to allow air therethrough to the interior of said flexible housing to inflate said figure when said flying toy is in flight.

14. The figure according to claim 13, in which said mating structure comprises a hook or loop configuration for coupling with said coupling structure.

15. The figure according to claim 13, in which said flexible housing has fill material located therewithin.

16. The figure for a flying toy according to claim 13, in which said figure is configured to move when in flight relative to said mating structure.

17. A flying toy, comprising:

a kite portion having a coupling structure; and a figure having mating structures to couple to said coupling structure and a remainder having a human-like or animal-like form;

whereby said figure remainder moves with respect to said mating structures and said kite portion.

18. The flying toy according to claim 17, in which said kite portion has a body portion and an airfoil portion, said figure being coupled to said kite portion above said kite body portion.

19. The flying toy according to claim 17, in which said coupling structure and said mating structure comprise a hook and loop configuration.

20. A flying toy, comprising:

a kite portion having a coupling structure; and a figure having mating structures to couple to said coupling structure and a remainder;

said figure being configured to inflate when in flight, whereby said figure remainder moves with respect to said mating structures and said kite portion.

21. A method of using a flying toy having coupling structures, including coupling a removably, selectively positional figure having mating structures to said coupling structures and a remainder having a human-like or animal-like form and not coupled to said flying toy; and flying the toy such that said figure remainder having a human-like or animal-like form moves relative to said mating structures and said flying toy.

22. The method according to claim 21, wherein said figure moves periodically or intermittently when in flight.

* * * * *